US005729246A

United States Patent [19]

Masuko

[11] Patent Number: 5,729,246

[45] Date of Patent: Mar. 17, 1998

[54] LIQUID CRYSTAL DISPLAY DEVICE AND DRIVE CIRCUIT THEREFOR

[75] Inventor: Akira Masuko, Katsushika-Ku, Japan

[73] Assignee: Kabushiki Kaisha Toshiba, Kawasaki, Japan

[21] Appl. No.: 679,751

[22] Filed: Jul. 10, 1996

[30] Foreign Application Priority Data

Jul. 10, 1995 [JP] Japan ..... 7-173422

[51] Int. Cl.[6] ..... G09G 3/36

[52] U.S. Cl. ..... 345/98; 345/211

[58] Field of Search ..... 345/98, 99, 100, 345/87, 89, 94, 95, 208, 210, 211, 212, 213, 147, 96; 349/33, 34; 348/790, 791, 792, 793

[56] References Cited

U.S. PATENT DOCUMENTS

| | | | |
|---|---|---|---|
| 4,570,115 | 2/1986 | Misawa et al. | 345/212 |
| 5,229,761 | 7/1993 | Fuse | 345/211 |
| 5,453,757 | 9/1995 | Date et al. | 345/89 |
| 5,489,910 | 2/1996 | Kuwata et al. | 345/96 |
| 5,517,212 | 5/1996 | Inoue | 345/211 |

*Primary Examiner*—Xiao Wu
*Attorney, Agent, or Firm*—Oblon, Spivak, McClelland, Maier & Neustadt, P.C.

[57] ABSTRACT

A drive circuit for a liquid crystal display device, includes: an operational amplifier supplied at one input terminal with display data used for liquid crystal display; a capacitor connected between the other input terminal of the operational amplifier and the external output terminal; and, e.g., a first switching element provided at the input side of the operational amplifier and supplied with a first voltage, a second switching element connected to the external output terminal at the output side of the operational amplifier and supplied with a second voltage and a third switching element provided between the output terminal of the operational amplifier and the external output terminal. The drive circuit further includes a switch control circuit connected to the switching elements, and operative to allow the first and second switching elements to be turned ON for a first time period within each liquid crystal display cycle to produce a predetermined potential difference across the both ends of the capacitor, and to allow them to be turned OFF for a second time period within the liquid crystal display cycle, and further operative to allow the third switching element to be turned OFF for the first time period, and to allow it to be turned ON for the second time period to thereby output, from the external output terminal, for the second time period, a voltage obtained by adding the predetermined potential difference and a voltage on the output terminal of the operational amplifier.

16 Claims, 7 Drawing Sheets

LIQUID CRYSTAL DISPLAY DEVICE AND DRIVE CIRCUIT THEREFOR

BACKGROUND OF THE INVENTION

This invention relates to a circuit for driving a liquid crystal display panel and a liquid crystal display device driven by such a drive circuit, and more particularly to a circuit suitable when used as a source driver for controlling display data in driving a liquid crystal display panel of the active matrix type using TFTs (Thin Film Transistors), and a liquid crystal display device driven by such a drive circuit.

In the case of driving the liquid crystal panel, in order to represent luminance ranging from the minimum luminance to the maximum luminance, it is sufficient that the drive (applied) voltage generally has voltage width of about 5 volts. Therefore, the case in which the liquid crystal panel is driven by 5 volts will be described, as one example, in the following. In the case of driving the liquid crystal, it is necessary to carry out a.c. drive in order not to deteriorate the characteristic thereof. For this reason, a signal voltage having voltage width of 10 volts with voltage of 5 volts being as center is required for the liquid crystal drive.

The configuration of a drive circuit for liquid crystal display device related to this invention is shown in FIG. 1. From a display data generating circuit 10, a picture signal v sig having the range of 0 to 10 volts is outputted. The picture signal thus outputted is inputted to the non-inverting input terminal of an operational amplifier 20 constituting a voltage follower circuit. The inverting input terminal of the operational amplifier 20 is connected to the output terminal thereof, and impedance conversion is thus carried out. As a result, the same voltage v sig is outputted from an output terminal 3 to the external.

Between the output terminal 3 and a pixel electrode 5*a* corresponding to one pixel provided at a liquid crystal panel 5, the both ends of a TFT 4 are connected. A gate control signal vg is inputted to the gate of the TFT 4 so that ON/OFF operation is controlled. At the opposite surface of the pixel electrode 5*a* of the liquid crystal panel 5, a common electrode 5*b* is provided. A common voltage v com of 5 volts is applied thereto.

As shown in FIG. 2, the luminance becomes maximum with the common voltage v com being as center. According as the applied (drive) voltage rises from 5 volts toward 10 volts, the luminance is lowered gradually. Moreover, according as the applied voltage falls from 5 volts toward 0 volts, the luminance is similarly lowered gradually.

As stated above, the output voltage v sig from the display data generating circuit 10 shown in FIG. 1 is required to have voltage width of 10 volts, and the impedance conversion circuit composed of display data generating circuit 10 and operational amplifier 20 is constituted with the circuit of 10 volts system.

However, when the display data generating circuit 10 and the operational amplifier 20 are manufactured so that the entirety of the drive circuit can operate at 10 volts, there were the problems that increase in the current consumption results and the chip area is increased.

As another drive circuit related to this invention, some drive circuits employ, without using a system of limiting the range of the output voltage v sig to 5 volts, an approach to invert voltage v com applied to the common electrode 5*b* every display cycle to thereby realize a.c. drive. With such drive circuits, however, there is the problem that the circuit configuration becomes complicated so that there results increase in the number of parts, with the result that the current consumption is increased.

SUMMARY OF THE INVENTION

Accordingly, an object of this invention is to provide a drive circuit for a liquid crystal display device in which reduction in the power consumption and reduction in the chip area can be made, and a liquid crystal display device driven by such a drive circuit.

In accordance with this invention, there is provided a drive circuit for a liquid crystal display device, comprising: an operational amplifier supplied at one input terminal with display data used for liquid crystal display; a capacitor connected between the other input terminal of the operational amplifier and an external output terminal; a first switching element connected between a first external input terminal supplied with a first voltage and the other input terminal of the operational amplifier; a second switching element connected between a second external input terminal supplied with a second voltage and the external output terminal; a third switching element connected between an output terminal of the operational amplifier and the external output terminal; and a switch control circuit connected to the first, second and third switching elements, the switch control circuit being operative to allow the first and second switching elements to be turned ON for a first time period within each liquid crystal display cycle to produce a predetermined potential difference across the both ends of the capacitor and to allow those first and second switching elements to be turned OFF for a second time period within the liquid crystal display cycle, and to allow the third switching element to be turned OFF for the first time period and to allow the third switching element to be turned ON for the second time period to thereby output a voltage obtained by adding the predetermined potential difference and a voltage on the output terminal of the operational amplifier from the external output terminal for the second time period.

In operation, liquid crystal display data is inputted to one input terminal of the operational amplifier. Thus, impedance conversion is carried out. As a result, this liquid crystal display data is outputted from the output terminal. For the first time period of the liquid crystal display cycle, the first switching element and the second switching element are turned ON by the switch control circuit. As a result, a predetermined potential difference is produced across the both ends of the capacitor. For this first time period, the third switching element is in OFF state. Therefore, the liquid crystal display data outputted from the operational amplifier is not outputted to the external terminal. Subsequently, for the second time period of the liquid crystal display cycle, the first and second switching elements are turned OFF, and the third switching element is turned ON. Thus, a voltage in which the predetermined potential difference produced across the both ends of the capacitor is added to the liquid crystal display data is outputted from the external output terminal.

In alternative form, between the second external input terminal and the external output terminal, the second and third switching elements are connected in parallel. Between the third external input terminal and the external output terminal, a fourth switching element is connected. In the case where these first, second, third and forth switching elements are connected to the control circuit, the second switching element is turned ON for the first time period at one alternate liquid crystal display cycles, and the third switching element is turned ON alternately therewith for the first time period at the other alternate liquid crystal display cycles. Thus, a predetermined potential difference is produced across the both ends of the capacitor. When the operation timing enters the second time period of the liquid crystal display cycle, the first, second and third switching elements are all turned OFF, and the fourth switching element is turned ON. As a result, the predetermined potential difference produced across the both ends of the capacitor is added to display data outputted from the operational amplifier. An added voltage thus obtained is outputted from the external output terminal to the external.

In this case, in place of the fourth switching element, there may be employed an operational amplifier operative so that switching between the enable state and the disable state is carried out in accordance with (response to) a control signal inputted thereto, and a control circuit for outputting a control signal.

In the case where the operational amplifier has enable function as stated above, the operational amplifier is caused to undergo state change in accordance with the control signal such that the operational amplifier is brought into disable state for the first time period and is brought into enable state for the second time period, whereby the predetermined potential difference produced across the both ends of the capacitor is added to the display data outputted from the operational amplifier similarly to the above-described case, and an added voltage thus obtained is outputted to the external.

Moreover, another drive circuit of this invention comprises: an operational amplifier supplied at one input terminal with display data used for liquid crystal display, the operational amplifier being operative so that switching between the enable state and the disable state is carried out in accordance with a control signal inputted thereto; a capacitor connected between the other input terminal of the operational amplifier and an external output terminal; a first switching element connected between a first external input terminal supplied with a first voltage and the other input terminal of the operational amplifier; a second switching element connected between a second external input terminal supplied with a second voltage and the external output terminal; a switch control circuit connected to the first and second switching elements, the switch control circuit being operative to allow the first switching element and the second switching element to be turned ON for a first time period within each liquid crystal display cycle to thereby produce a predetermined potential difference across the both ends of the capacitor, and to allow the first and second switching elements to be turned OFF for a second time period within the liquid crystal display cycle; and a control circuit connected to the operational amplifier, and operative to deliver the control signal to the operational amplifier to allow the operational amplifier to be in disable state for the first time period and to allow the operational amplifier to be in enable state for the second time period, whereby, for the second time period, a voltage obtained by adding the predetermined potential difference and a voltage on the output terminal of the operational amplifier is outputted from the external output terminal.

Such an approach is employed as described above to produce a predetermined potential difference across the both ends of the capacitor to add it to display data every cycle, thereby making it possible to output, to the external, data having potential width broader than that of display data inputted to the operational amplifier.

In this case, in place of the fourth switching element, there may be employed an operational amplifier operative so that switching between the enable state and the disable state is carried out in accordance with a control signal inputted thereto.

In addition, liquid crystal display device of this invention comprises any one of the above-mentioned drive circuits and a liquid crystal panel driven by the drive circuit.

DESCRIPTION OF THE PREFERRED EMBODIMENTS

A drive circuit for a liquid crystal display device according to respective embodiments of this invention will now be described with reference to the attached drawings.

Figure 1:
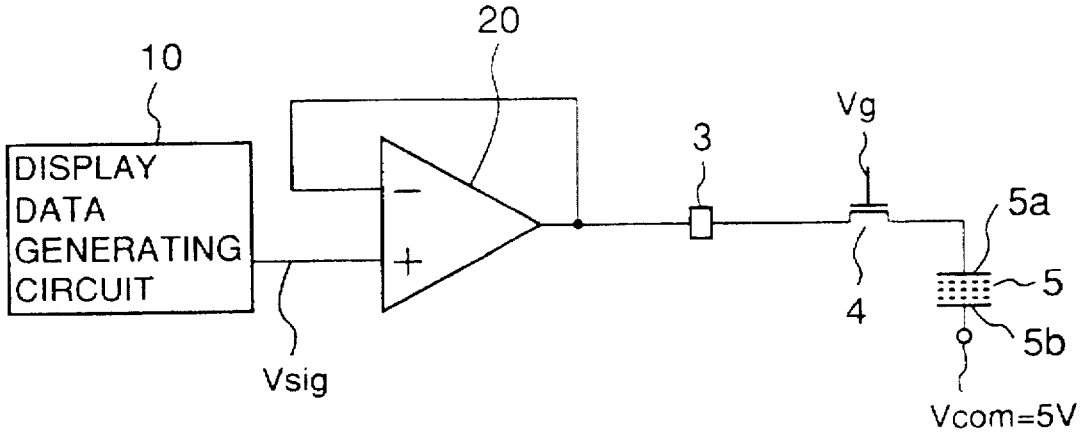
FIG. 1 is a circuit diagram showing the configuration of a drive circuit for a liquid crystal display device related to this invention.
Figure 2:
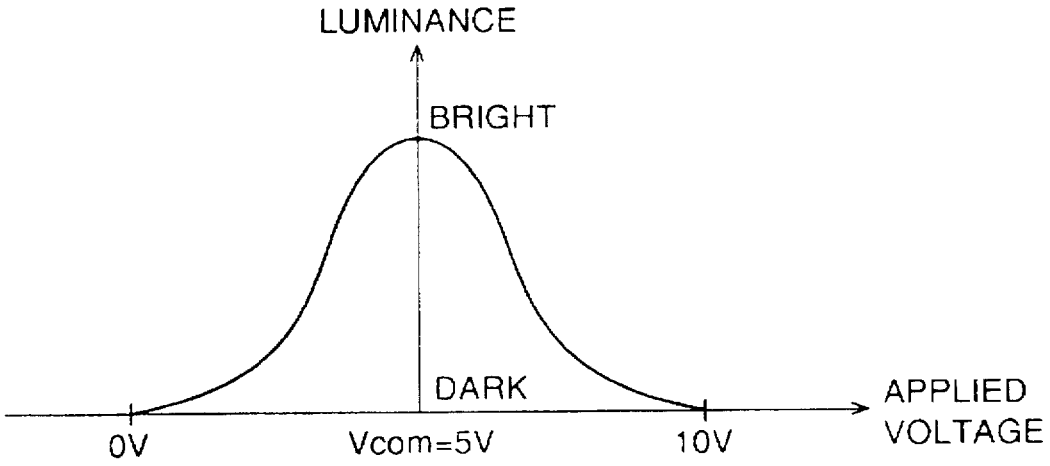
FIG. 2 is an explanatory view showing signal voltage having 10 volt width produced by the drive circuit.
Figure 3:
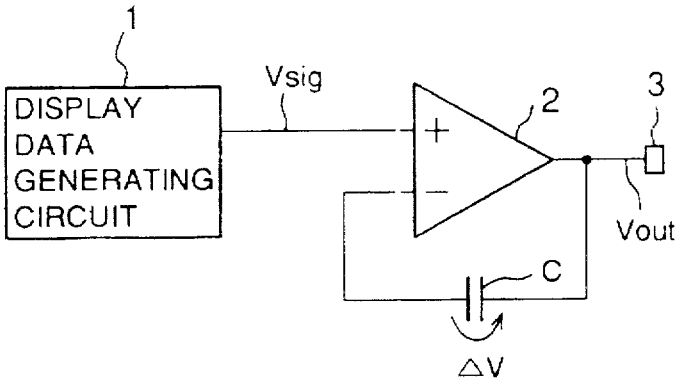
FIG. 3 is an explanatory view for explaining the concept of a drive circuit of a liquid crystal display device according to this invention.

Initially, the fundamental principle of this invention will be described below with reference to FIG. 3. A display data generating circuit 1 is such that the voltage range of signal voltage v sig to be outputted is 0 to 5 volts differently from the display data generating circuit 10 in the device shown in FIG. 1. It is to be noted that the impedance conversion circuit comprised of operational amplifier 2 supplied with the signal voltage v sig is constituted with a circuit of 10 V (volts) system.

A signal voltage v sig outputted from the display data generating circuit 1 is inputted to the non-inverting input terminal of the operational amplifier 2, and both ends of capacitor C are connected between the inverting input terminal and the output terminal.

When charges are charged (accumulated) into this capacitor C, a potential difference $\Delta v$ is produced across the both ends thereof. Thus, voltage v out outputted from the operational amplifier 2 to external output terminal 3 is expressed, when voltage inputted to the inverting input terminal is designated at v sig, as follows:

$$v\ out = v\ sig + \Delta v \quad (1)$$

Namely, potential difference Δv produced across both ends of the capacitor C is added to the signal voltage v sig outputted from the display data generating circuit 1. An added voltage thus obtained is outputted to the external.

Figure 4:
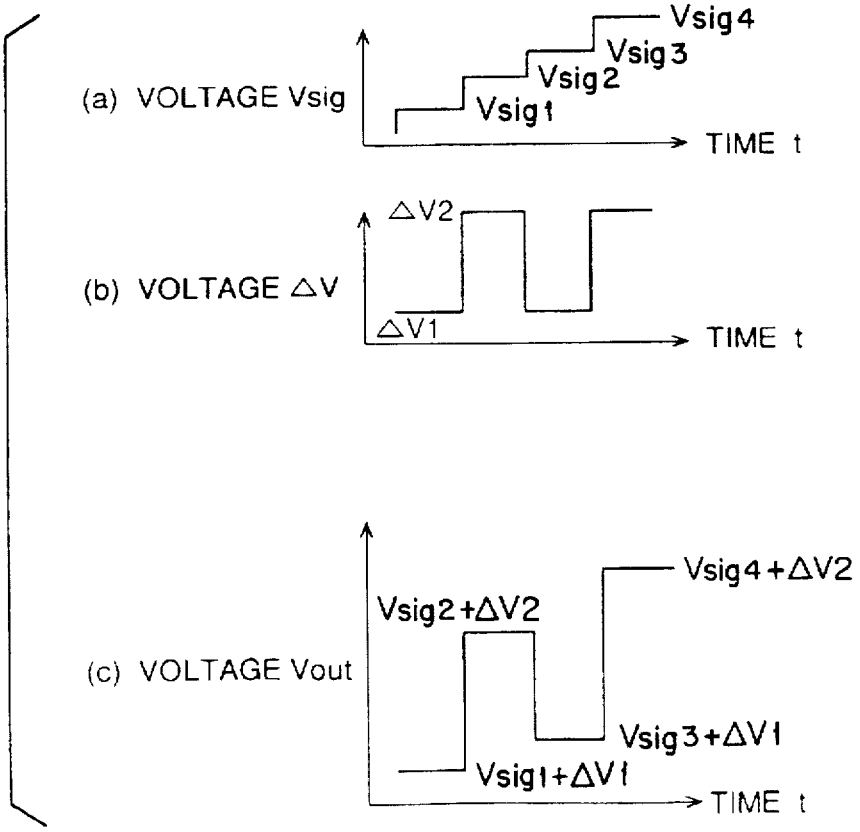
FIGS. 4(*a*) to (*c*) are time charts showing waveforms of respective voltages in the drive circuit shown in FIG. 1.

Potential change with respect to the time of the signal voltage v sig is shown in FIG. 4(*a*), change of potential difference Δv produced across the both ends of the capacitor C is shown in FIG. 4(*b*), and change of output voltage v out outputted from the operational amplifier 2 is shown in FIG. 4(*c*).

With respect to the potential difference Δv caused to be produced across the both ends of the capacitor C, it is necessary to periodically repeat Δv1 and Δv2 every liquid crystal display cycle as shown in FIG. 4(*b*). For example, in the case where Δv1 is assumed to be ground potential, Δv2 becomes equal to +5 volts. The signal voltage v sig changes from Vsig1 to Vsig4 in the range of 0 to 5 volts as shown in FIG. 4(*a*). Δv is added to such a signal voltage v sig, and output voltage v out thus changes as shown in FIG. 4(*c*). As a result, a signal having the range of 10 volts is outputted from the external output terminal 3. Thus, a.c. drive is realized.

Figure 5:
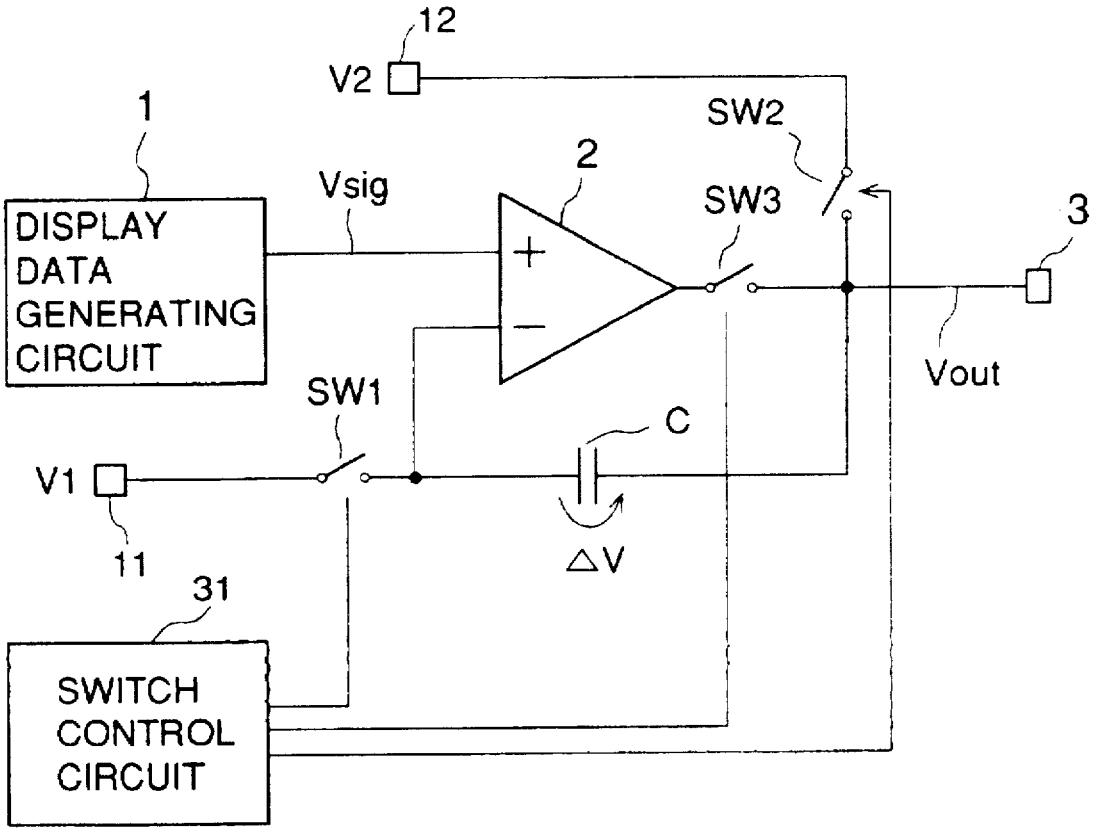
FIG. 5 is a circuit diagram showing the configuration of a drive circuit for a liquid crystal display device according to a first embodiment of this invention.

As a more practical one embodiment of this invention having such principle, the configuration of a first embodiment is shown in FIG. 5. In order to produce potential difference Δv across the capacitor C shown in FIG. 3, this embodiment is constituted as follows. Input terminals 11 and 12 are respectively supplied with voltages v1 and v2 from the external. Between the input terminal 11 and the inverting input terminal of the operational amplifier 2, a switch SW1 is connected. Between the input terminal 12 and external output terminal 3, a switch SW2 is connected. Between the external output terminal 3 and the output terminal of the operational amplifier 2, a switch SW3 is connected. These switches SW1 to SW3 are adapted so that their opening/closing operations are controlled by a switch control circuit 31. The switch control circuit 31 receives a signal from CPU or pulse generator (not shown) for prescribing (providing) timings of drive of the liquid crystal panel device to generate control signals for controlling the switches SW1 to SW3.

Figure 6:
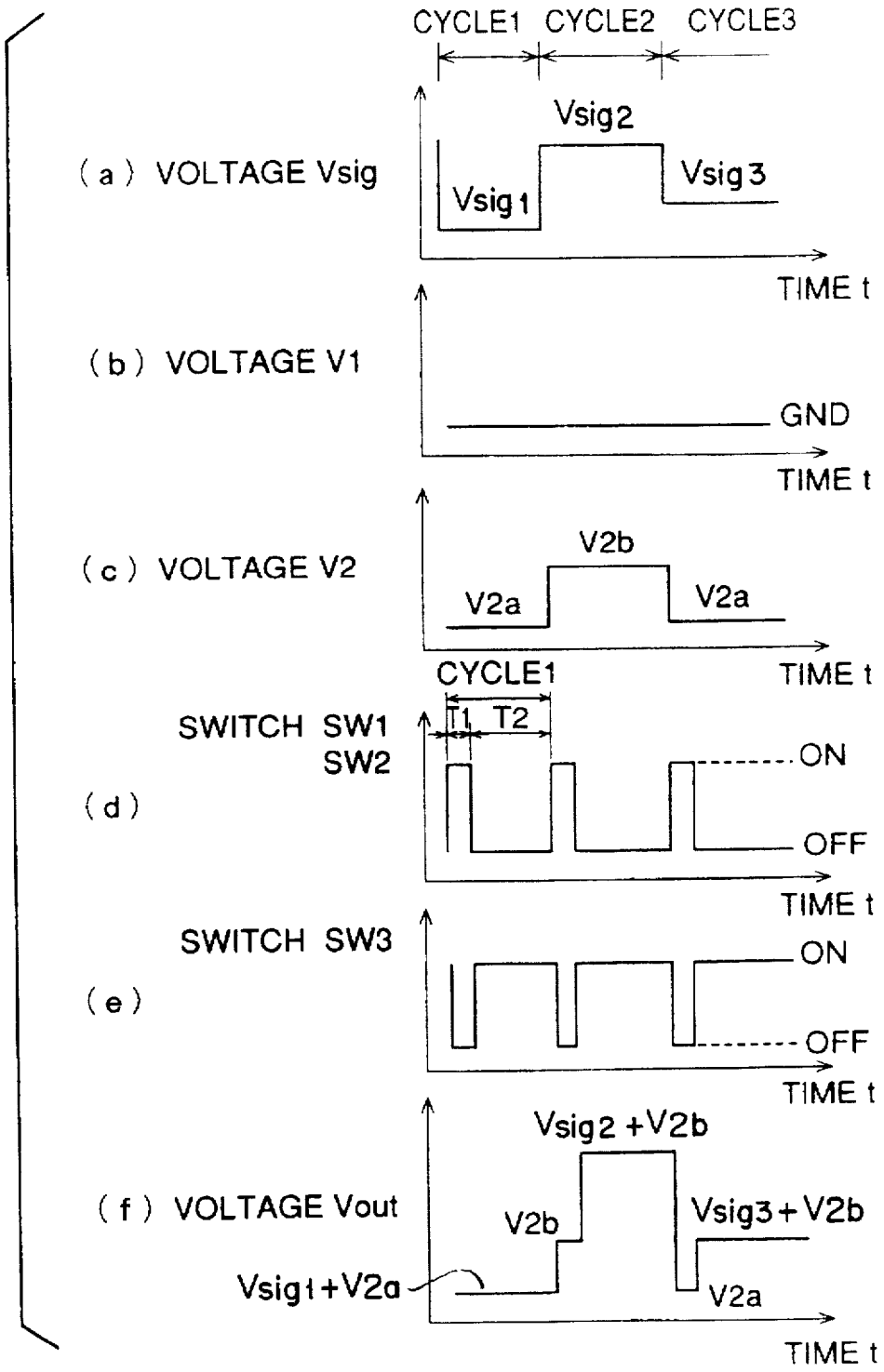
FIGS. 6(*a*) to (*f*) are time charts showing respective voltage waveforms and timings of opening/closing operations of respective switches in the above-mentioned drive circuit.

Change in point of time of the signal voltage v sig varying within the range of 5 volts is shown in FIG. 6(*a*), change in point of time of the voltage v1 is shown in FIG. 6(*b*), and change in point of time of the voltage v2 is shown in FIG. 6(*c*). Timings at which the switches SW1 and SW2 are turned ON/OFF are shown in FIG. 6(*d*), and timing at which the switch SW3 is turned ON/OFF is shown in FIG. 6(*e*). Additionally, change in point of time of the output voltage v out outputted from the external output terminal 3 is shown in FIG. 6(*f*).

First, at the initial time period T1 of the liquid crystal display cycles 1, 2, 3, . . . , the switches SW1 and SW2 are turned ON and the switch SW3 is turned OFF. Thus, a potential difference Δv expressed as Δv=v2−v1 is produced across the both ends of the capacitor C. It is desirable that this time period T1 is the minimum time required for charging the capacitor C.

Subsequently, at the remaining time period T2 within this cycle, the switches SW1 and SW2 are turned OFF, and the switch SW3 is turned ON. Thus, a voltage v out expressed as v out=v sig+Δv=v sig+(v2−v1) is outputted from the external output terminal 3.

As stated above, in accordance with the first embodiment, signal voltage v sig having the voltage range of 5 volts is generated from the display data generating circuit 1 to generate Δv across the capacitor C every liquid crystal display cycle, thus making it possible to output, from the external output terminal 3, a voltage v out having voltage width of 10 volts in which ΔV is added to the signal voltage v sig. Thus, it is possible to manufacture the display data generating circuit 1 by the circuit of 5 V (volts) system. As a result, power consumption can be reduced. In addition, in this embodiment, even if polarity of the common voltage to be applied to the common electrode 5*b* is not inverted every cycle, it is possible to carry out a.c. drive of the liquid crystal in the state where the polarity of the common electrode is fixed. Thus, it can be prevented that the circuit configuration becomes complicated.

Figure 7:
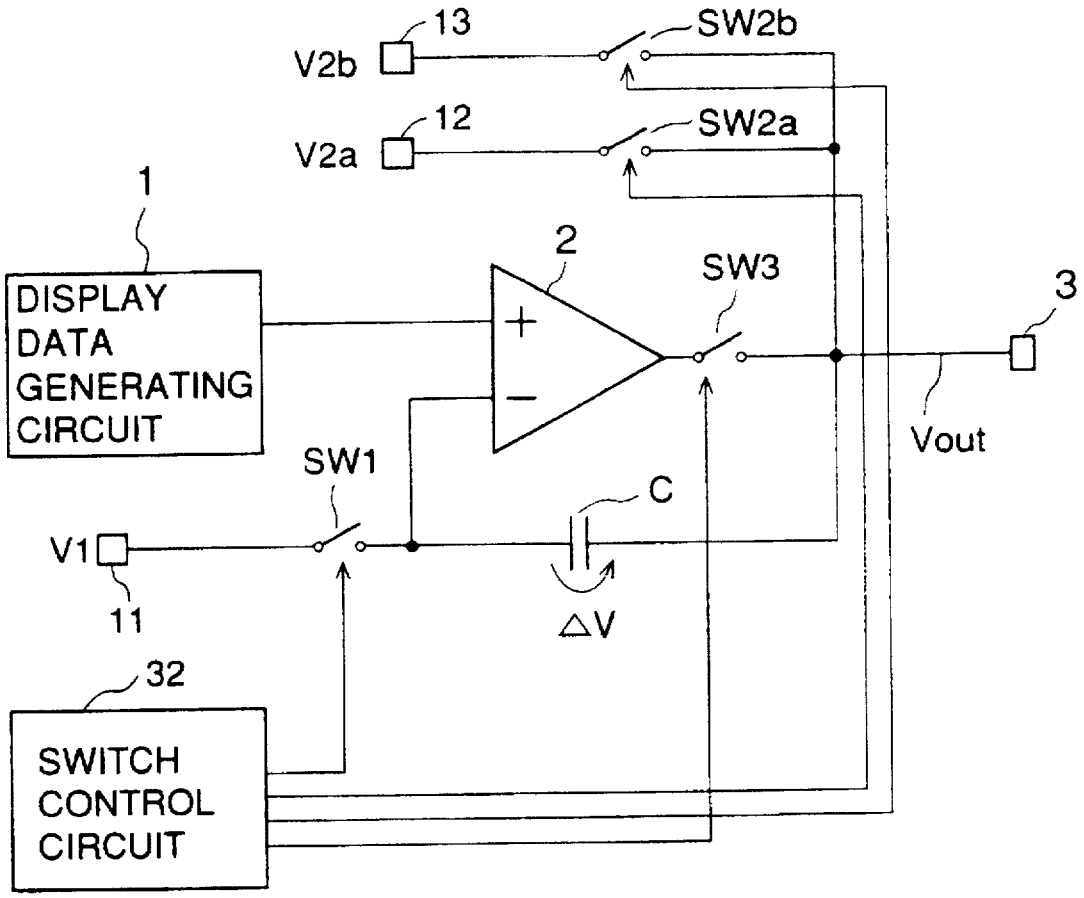
FIG. 7 is a circuit diagram showing the configuration of a drive circuit for a liquid crystal display device according to a second embodiment of this invention.

A second embodiment of this invention will now be described with reference to FIGS. 7 and 8. The drive circuit according to this embodiment has the configuration shown in FIG. 7. In the above-described first embodiment, one input terminal 12 is connected to output terminal 3 through switch SW2. From this input terminal 12, a voltage v2 such that voltage v2*a* and voltage v2*b* are periodically switched by turns is inputted.

On the contrary, in the second embodiment, two input terminals 12 and 13 are connected to the output terminal 3 respectively through switches SW2*a* and SW2*b*. The switches SW1, SW2*a*, SW2*b*, SW3 are connected to a switch control circuit 32, and are adapted so that their opening/closing operations are controlled by control signals that the switch control circuit 32 outputs.

Figure 8:
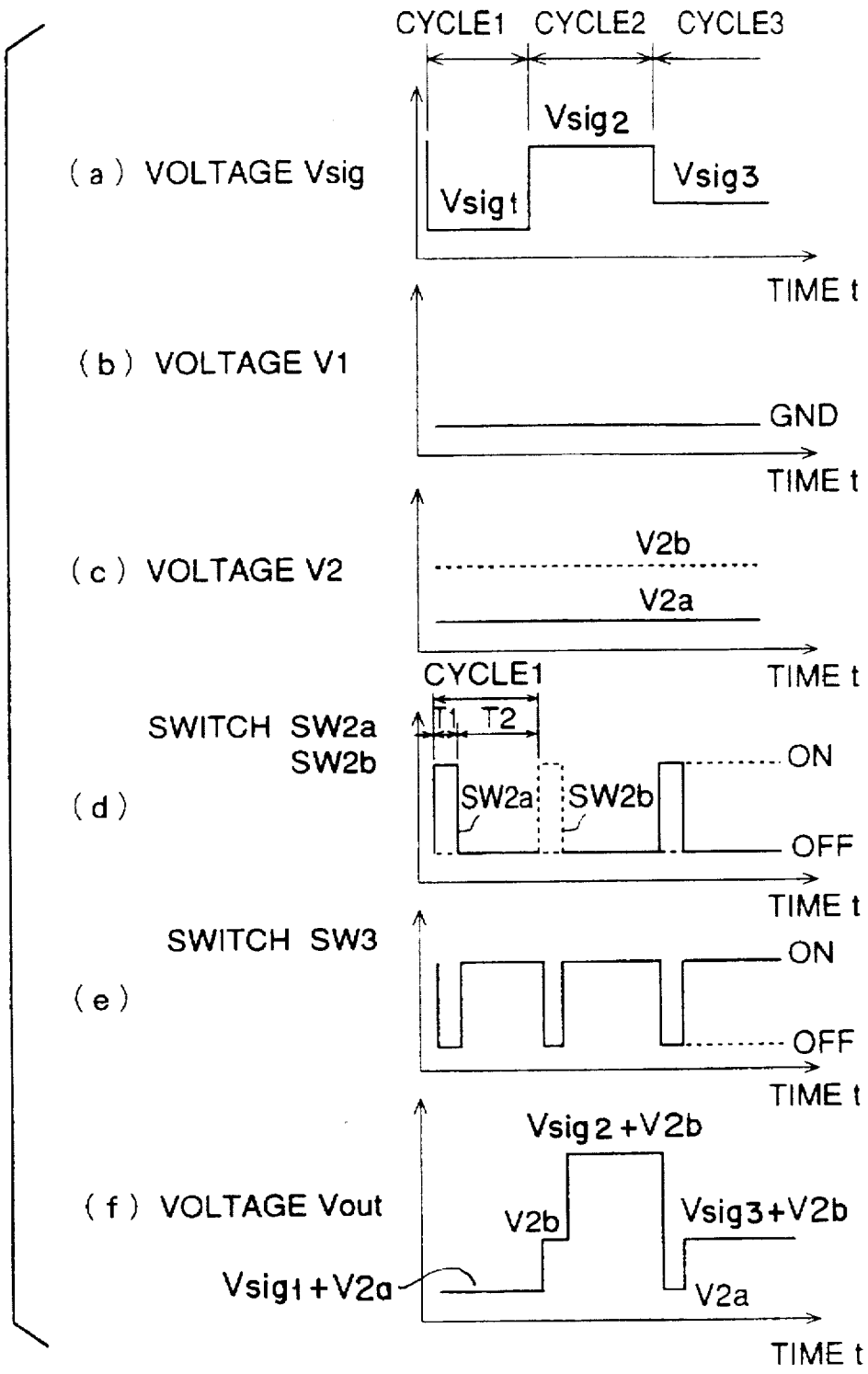
FIGS. 8(*a*) to (*f*) are time charts showing respective voltage waveforms and timings of opening/closing operations of respective switches in the above-mentioned drive circuit.

A fixed voltage v2*a* as shown in FIG. 8(*c*) is inputted from the input terminal 12. Moreover, a fixed voltage v2*b* is inputted from the input terminal 13. These voltages v2*a* and v2*b* are respectively the same as the voltage v2*a* and v2*b* in the first embodiment shown in FIG. 6(*c*). Further, the opening/closing operations of the switches SW2*a* and SW2*b* are controlled in accordance with timings as shown in FIG. 8(*d*). The switch SW2*a* is operative so that it is turned ON at the initial time period T1 of one alternate display cycles, and is turned OFF at the time period T1 of the other alternate display cycles. In a manner opposite to the above, the switch SW2*b* is operative so that it is turned ON at the time period T1 of one alternate display cycles during which the switch SW2*a* is in OFF state, and is turned OFF at the time period T1 of the other alternate display cycles. The same reference numerals are respectively attached to other components which are the same as those of the first embodiment, and their explanation is omitted. In addition, timings at which the switches SW1 and SW3 except for switches SW2*a* and SW2*b* are opened/closed (subjected to ON/OFF operation) are the same as those of the first embodiment.

At the time period T1 in display cycles 1, 2, 3, . . . during which signal voltage v sig is applied to respective liquid crystal pixels, the switches SW2*a* and SW2*b* are reciprocally turned ON or OFF at alternate cycles as shown in FIG. 8(*d*). Thus, similarly to the first embodiment, voltage v2*a* and voltage v2*b* as shown in FIG. 6(*c*) in the first embodiment reciprocally appear on the output terminal 3. A potential difference Δv between the voltage applied to the output terminal 3 and the voltage v1 inputted from the input terminal 11 through the switch SW1 is produced across the both ends of the capacitor C.

At respective liquid crystal display cycles, when the operation timing enters the time period T2, the switch SW1, the switch SW2*a* and switch SW2*b* are both turned OFF, and the switch SW3 is turned ON. Thus, the signal voltage v sig which has been outputted from the operational amplifier 2 is outputted to the output terminal 3. As a result, a voltage v out in which potential difference Δv produced across the both ends of the capacitor C is added to (superposed on) the signal voltage v sig is outputted as shown in FIG. 8(*f*) from the output terminal 3. Accordingly, similarly to the first embodiment, it is possible to manufacture the display data generating circuit 1 by the circuit of 5 volts system, and to output a signal v out having voltage width of 10 V (volts).

Figure 9:
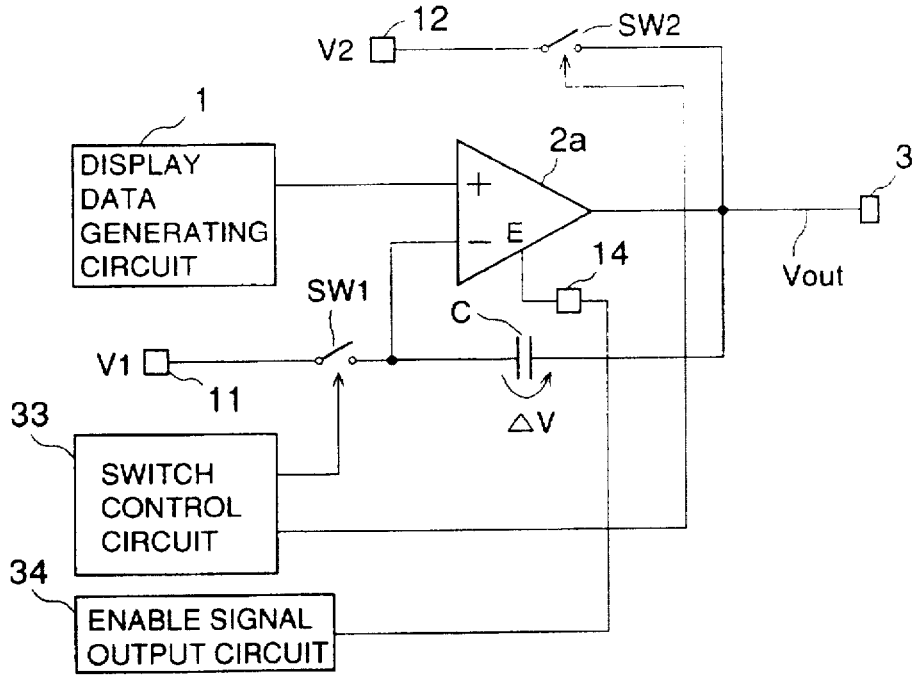
FIG. 9 is a circuit diagram showing the configuration of a drive circuit for a liquid crystal display device according to a third embodiment of this invention.

A drive circuit according to a third embodiment of this invention will now be described with reference to FIG. 9. In the first embodiment and the second embodiment, timing at which the output is generated from the operational amplifier 2 is set by the switch SW3 connected between the output terminal 3 and the output terminal of the operational amplifier 2. On the contrary, the third embodiment is characterized in that, in place of providing the switch SW3, an operational amplifier 2*a* caused to have output enable/disable function is used. The same reference numerals are respectively attached to other components which are the same as those of the first embodiment, and their explanation is omitted. In addition, the timings at which the switches SW1 and SW2 are opened/closed (subjected to ON/OFF operation) are assumed to be the same as those of the first embodiment.

The switches SW1 and SW2 are adapted so that their opening/closing operations are controlled by a switch control circuit 33. The operational amplifier 2*a* receives an enable signal from an enable signal output circuit 34 so that the enable/disable state is controlled. The enable signal output circuit 34 receives a signal from CPU or pulse timing generator (not shown) similarly to that of the switch control circuit 33 to output an enable signal.

At the initial time periods T1 of respective liquid crystal display cycles 1, 2, 3, . . . , switches SW1 and SW2 are turned ON similarly to the first embodiment. As a result, a potential difference Δv is produced across the both ends of the capacitor C. At this stage, no enable signal E is given (applied) to an enable terminal 14 of the operational amplifier 2*a*, so the operational amplifier 2*a* is in disable state. Therefore, no signal voltage v sig is outputted. Subsequently, at the time period T2 of this cycle, the switches SW1 and SW2 are turned OFF, and the enable signal E is instead inputted to the enable terminal 14. As a result, the operational amplifier 2 is brought into the enable state. Thus, a voltage v out in which potential difference Δv of the capacitor 2 is added to the signal voltage v sig is outputted from the output terminal 3 to the external.

Figure 10:
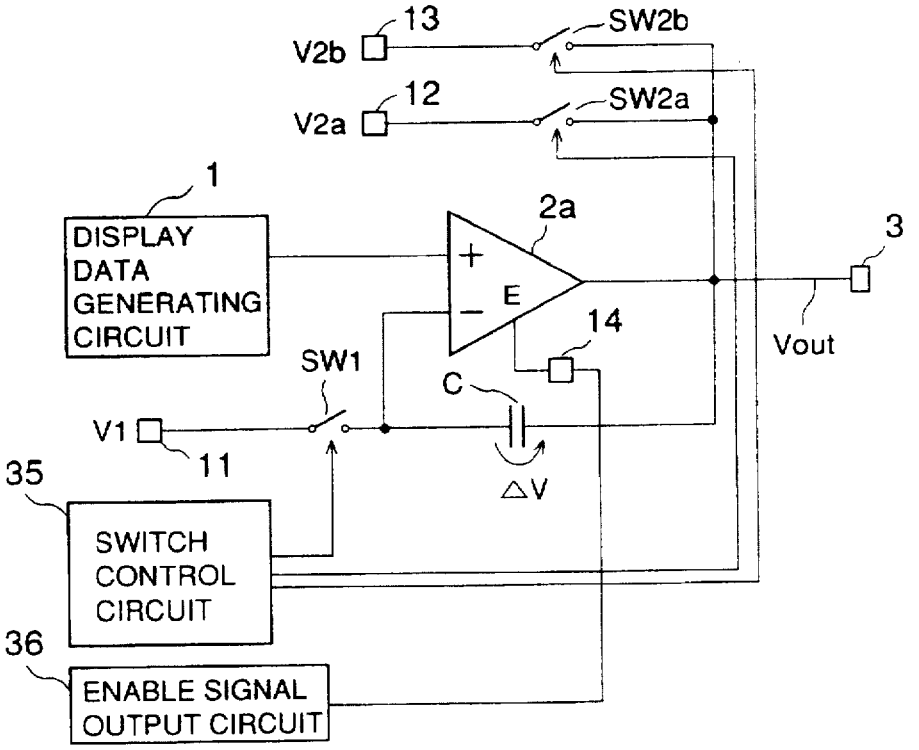
FIG. 10 is a circuit diagram showing the configuration of a drive circuit for a liquid crystal display device according to a fourth embodiment of this invention.

A forth embodiment of this invention has a configuration as shown in FIG. 10. This embodiment corresponds to the example where, in place of providing switch SW3, operational amplifier 2*a* having output enable function is used. Other components are the same as those of the second embodiment. Therefore, the same reference numerals are respectively attached thereto, and their explanation is omitted.

Moreover, switches SW1, SW2*a*, SW2*b* are adapted so that their opening/closing operations are controlled by a switch control circuit 35, and the operational amplifier 2*a* is adapted so that the enable/disable state is controlled by enable signal outputted from an enable signal output circuit 36.

At the initial time periods T1 of respective cycles, the switch SW1 is turned ON, and any one of the switches SW2*a* and SW2*b* is alternately turned ON. Thus, a potential difference Δv is produced across the capacitor C. At this time, voltages v1, v2*a*, v2*b* respectively inputted to the input terminals 11 . . . 13 are the same as those of the second embodiment. No enable signal E is inputted to enable terminal 14 of the operational amplifier 2*a* so that it is in disable state. Subsequently, the switch SW1, and the switches SW2*a*, SW2*b* are all turned OFF, and enable signal E is inputted to the enable terminal 14 so that the operational amplifier 2*a* is brought into the enable state. Thus, signal voltage v sig is outputted to the output terminal 3. As a result, a voltage v out in which potential difference Δv is added to the signal voltage v sig is outputted from the output terminal 3.

As described above, in accordance with the first to fourth embodiments, an approach is employed to produce potential difference Δv across the both ends of the capacitor C connected between the output terminal and the inverting input terminal of the operational amplifier 2 or 2*a* to output, to the external, voltage v out in which the potential difference Δv is added to the signal voltage v sig outputted from the display data generating circuit 1. Thus, even if voltage width of the signal voltage v sig outputted from the display data circuit 1 is 5 volts, values of the potential difference of 5 volts are added at alternate liquid crystal display cycles, thereby making it possible to carry out a.c. drive of the liquid crystal by using voltage v out having voltage width of 10 volts. Accordingly, it is possible to manufacture the display data generating circuit 1 as a circuit of 5 V (volts) system. Thus, increase in current consumption can be suppressed. In addition, even if an approach is not employed to allow the liquid crystal to undergo a.c. drive by common voltage applied to the common electrode Vcom, the liquid crystal can be subjected to a.c. drive by voltage v out having voltage width of 10 volts. Thus, it can be prevented that the circuit configuration becomes complicated.

It should be noted that all of the above-described embodiments are presented only for illustrative purpose, and do not limit this invention by any means. While, e.g. switches SW1, SW2, SW2*a*, SW2*b* and SW3 are illustrated as mechanical switch in the drawings, any element to carry out switching operation like transistor, etc. may be used. In the third and fourth embodiments, there is used operational amplifier 2*a* adapted so that when enable signal E is inputted thereto, it is brought into the enable state. However, there may be used an operational amplifier such that, in a manner opposite to the above, it is ordinarily in enable state, and is brought into disable state when disable signal DE is inputted thereto.

What is claimed is:

1. A drive circuit for a liquid crystal display device, comprising:

an operational amplifier supplied at one input terminal with display data used for liquid crystal display;

a capacitor connected between the other input terminal of the operational amplifier and an external output terminal;

a first switching element connected between a first external input terminal supplied with a first voltage and the other input terminal of the operational amplifier;

a second switching element connected between a second external input terminal supplied with a second voltage and the external output terminal;

a third switching element connected between an output terminal of the operational amplifier and the external output terminal;

a switch control circuit connected to the first, second and third switching elements, the switch control circuit being operative to allow the first and second switching elements to be turned ON for a first time period within each liquid crystal display cycle to produce a predetermined potential difference across the both ends of the capacitor, and to allow those first and second switching elements to be turned OFF for a second time period within the liquid crystal display cycle, the switch control circuit being operative to allow the third switching element to be turned OFF for the first time period, and to allow the third switching element to be turned ON for the second time period to thereby output, from the external output terminal, for the second time period, a voltage in which the predetermined potential difference and a voltage on the one input terminal of the operational amplifier are added.

2. A drive circuit for a liquid crystal display device as set forth in claim 1, wherein the first time period is the minimum time required for charging the capacitor.

3. A liquid crystal display device comprising:

the drive circuit for the liquid crystal display device as set forth in claim 1, and a liquid crystal panel driven by the drive circuit.

4. A drive circuit for a liquid crystal display device as set forth in claim 1, wherein the first voltage is fixed to a constant potential, and wherein the second voltage is caused to undergo switching between a first level and a second level every liquid crystal display cycle.

5. A drive circuit for a liquid crystal display device, comprising:

an operational amplifier supplied at one input terminal with display data used for liquid crystal display;

a capacitor connected between the other input terminal of the operational amplifier and an external output terminal;

a first switching element connected between a first external input terminal supplied with a first voltage and the other input terminal of the operational amplifier;

a second switching element connected between a second external input terminal supplied with a second voltage and the external output terminal;

a third switching element connected between a third external input terminal supplied with a third voltage and the external output terminal;

a fourth switching element connected between an output terminal of the operational amplifier and the external output terminal;

a switch control circuit connected to the first, second, third and fourth switching elements, the switch control circuit being operative to allow the first switching element to be turned ON for a first time period within the liquid crystal display cycle, to allow the second switching element to be turned ON for the first time period within the alternate liquid crystal display cycles, to allow the third switching element to be turned ON for the first time period within the liquid crystal display cycle during which the second switching element is not turned ON to thereby produce a predetermined potential difference across the both ends of the capacitor, and to allow the fourth switching element to be turned OFF for the first time period and to allow it to be turned ON for a second time period to thereby output, from the external output terminal, for the second time period, a voltage in which the predetermined potential difference and a voltage on the one input terminal of the operational amplifier are added.

6. A drive circuit for a liquid crystal display device as set forth in claim 5, wherein the first time period is the minimum time required for charging the capacitor.

7. A liquid crystal display device comprising:

the drive circuit for the liquid crystal display device as set forth in claim 5; and a liquid crystal panel driven by the drive circuit.

8. A drive circuit for a liquid crystal display device as set forth in claim 5, wherein the first voltage is fixed to a constant potential, wherein the second voltage is fixed to take a first level, and wherein the third voltage is fixed to take a second level.

9. A drive circuit for a liquid crystal display device, comprising:

an operational amplifier supplied at one input terminal with display data used for liquid crystal display, and operative so that switching between the enable and disable states is carried out in accordance with a control signal inputted thereto;

a capacitor connected between the other input terminal of the operational amplifier and an external output terminal;

a first switching element connected between a first external input terminal supplied with a first voltage and the other input terminal of the operational amplifier;

a second switching element connected between a second external input terminal supplied with a second voltage and the external output terminal;

a switch control circuit connected to the first and second switching elements, and operative to allow the first switching element and the second switching element to be turned ON for a first time period within each liquid crystal display cycle to thereby produce a predetermined potential difference across the both ends of the capacitor, and to allow those first and second switching elements to be turned OFF for a second time period within the liquid crystal display cycle; and a control circuit connected to the operational amplifier, and operative to deliver the control signal to the operational amplifier to allow the operational amplifier to be in disable state for the first time period, and to allow the operational amplifier to be in enable state for the second time period, whereby, for the second time period, a voltage in which the predetermined potential difference and a voltage on the one input terminal of the operational amplifier are added is outputted from the external output terminal.

10. A drive circuit for a liquid crystal display device as set forth in claim 9, wherein the first time period is the minimum time required for charging the capacitor.

11. A liquid crystal display device comprising:

the drive circuit for the liquid crystal display device as set forth in claim 9; and a liquid crystal panel driven by the drive circuit.

12. A drive circuit for a liquid crystal display device as set forth in claim 9, wherein the first voltage is fixed to a constant potential, and wherein the second voltage is caused to undergo switching between a first level and a second level every liquid crystal display cycle.

13. A drive circuit for a liquid crystal display, comprising:

an operational amplifier supplied at one input terminal with display data used for liquid crystal display, and operative so that switching between the enable and disable states is carried out in accordance with a control signal inputted thereto;

a capacitor connected between the other input terminal of the operational amplifier and an external output terminal;

a first switching element connected between a first external input terminal supplied with a first voltage and the other input terminal of the operational amplifier;

a second switching element connected between a second external input terminal supplied with a second voltage and the external output terminal;

a third switching element connected between a third external input terminal supplied with a third voltage and the external output terminal;

a switch control circuit connected to the first, second and third switching elements, the switch control circuit being operative to allow the first switching element to be turned ON for a first time period within the liquid crystal display cycle to allow the second switching element to be turned ON for the first time period within the alternate liquid crystal display cycles, and to allow the third switching element to be turned ON for the first time period within the liquid crystal display cycle during which the second switching element is not turned ON to thereby produce a predetermined potential difference across the both ends of the capacitor; and a control circuit connected to the operational amplifier, and operative to deliver the control signal to the operational amplifier to allow the operational amplifier to be in disable state for the first time period, and to allow it to be in enable state for the second time period, whereby, for the second time period, a voltage in which the predetermined potential difference and a voltage on the one input terminal of the operational amplifier are added is outputted from the external output terminal.

14. A drive circuit for a liquid crystal display device as set forth in claim 13, wherein the first time period is the minimum time required for charging the capacitor.

15. A liquid crystal display device comprising:

the drive circuit for liquid crystal display device as set forth in claim 13; and a liquid crystal panel driven by the drive circuit.

16. A drive circuit for a liquid crystal display device as set forth in claim 13, wherein the first voltage is fixed to a constant potential, wherein the second voltage is fixed to take first level, and wherein the third voltage is fixed to take second level.

* * * * *